US006915799B2

(12) United States Patent
Weiss

(10) Patent No.: US 6,915,799 B2
(45) Date of Patent: Jul. 12, 2005

(54) DAMPER CONTROL DEVICE FOR OUTSIDE APPLICATIONS

(75) Inventor: Cory A. Weiss, Warren, MI (US)

(73) Assignee: Flue Sentinel, Inc., Orion, MI (US)

( * ) Notice: Subject to any disclaimer, the term of this patent is extended or adjusted under 35 U.S.C. 154(b) by 0 days.

(21) Appl. No.: 10/730,798

(22) Filed: Dec. 5, 2003

(65) Prior Publication Data

US 2004/0115578 A1 Jun. 17, 2004

Related U.S. Application Data

(60) Provisional application No. 60/431,564, filed on Dec. 6, 2002.

(51) Int. Cl.[7] ..... F24B 1/189
(52) U.S. Cl. ..... 126/536
(58) Field of Search ..... 126/96, 512, 521, 126/531, 536; 431/20, 21; 454/16, 236

(56) References Cited

U.S. PATENT DOCUMENTS

| | | | | | |
|---|---|---|---|---|---|
| 2,349,443 | A | | 5/1944 | McCarty | |
| 4,017,024 | A | * | 4/1977 | Grostick et al. | 236/1 G |
| 4,143,811 | A | * | 3/1979 | Sattmann | 236/1 G |
| 4,204,833 | A | | 5/1980 | Kmetz | |
| 4,249,883 | A | * | 2/1981 | Woolfolk | 431/20 |
| 4,256,257 | A | * | 3/1981 | Pinkerton | 236/1 G |
| 4,273,097 | A | * | 6/1981 | Szwartz | 126/285 B |
| 4,406,396 | A | | 9/1983 | Habegger | |
| 4,550,874 | A | | 11/1985 | Clouser | |
| 4,778,378 | A | | 10/1988 | Dolnick | |
| 4,846,400 | A | | 7/1989 | Crouse | |
| 5,393,221 | A | | 2/1995 | McNally | |
| 5,555,876 | A | * | 9/1996 | Francisco et al. | 126/504 |
| 5,609,522 | A | * | 3/1997 | Szwartz | 454/7 |
| 6,257,871 | B1 | | 7/2001 | Weiss | |

* cited by examiner

*Primary Examiner*—Stephen Gravini
(74) *Attorney, Agent, or Firm*—Miller Canfield Paddock & Stone; Robert Kelley Roth

(57) ABSTRACT

A damper control device suitable for use in a fireplace comprises a flue, wherein products of combustion from the fireplace enter the flue, a damper positioned in a damper pipe which is connected to the flue, with the damper movable between open and closed positions, a motor having a shaft connected to the damper, and a control circuit which initiates combustion and which receives a damper signal which indicates whether the damper is in the open or closed position. In response to a request for heat, the control circuit initiates combustion after receiving the damper signal indicating that the damper is in the open position. The damper control device can also have a mounting ring extending generally perpendicularly form the damper pipe for connecting the damper pipe to the flue. For air-cooled flues, an adapter can be added to allow passage of air along the flue. A status module may be provided for operational or trouble-shooting purposes.

14 Claims, 6 Drawing Sheets

DAMPER CONTROL DEVICE FOR OUTSIDE APPLICATIONS

RELATED APPLICATION

This application claims priority benefit of U.S. provisional patent application No. 60/431,564 filed on Dec. 6, 2002.

FIELD OF THE INVENTION

This invention relates to a device for electronically controlling a damper in a flue, and more particularly to chimney mounted dampers.

BACKGROUND OF THE INVENTION

Many homes today have fireplaces where a flue in a chimney connects the outside air to the fireplace. Such a connection can result in leakage of cold air into the home. A damper was used in some instances to keep the cold air out. That is, in some instances a damper was positioned in the flue and was movable between a closed position which prevented air from leaking into or out of the home and an open position which allowed air to flow and exhaust products of combustion to flow out of the home. Such known dampers were controlled by a chain, handle, lever or the like and an operator had to remember to open the damper prior to starting a fire in the fireplace, or else the products of combustion would become trapped in the home.

The products of wood fireplaces can include soot and smoke. Soot and smoke are visible, and if a wood fireplace had a damper which was closed, it would become immediately apparent that the damper was closed upon combustion of the wood. However, the products of incomplete gas combustion can be invisible and toxic ($CO_2$, CO, for example). Because of this potentially hazardous situation, ventilation of air has been required for gas fireplaces where dampers have been used. That is, the damper had to be permanently blocked open. Further, in many places dampers were not allowed to be used in combination with gas fireplaces. It would be highly desirable to have a damper positioned in a fireplace, particularly a gas fireplace, so as to prevent air from entering or exiting a home and which is also safe and reliable.

SUMMARY OF THE INVENTION

In accordance with a first aspect, a damper control device suitable for use in a fireplace comprises a flue, wherein products of combustion from the fireplace enter the flue, a damper positioned in a damper pipe which is connected to the flue, with the damper movable between open and closed positions, a motor having a shaft connected to the damper, and a control circuit which initiates combustion and which receives a damper signal which indicates whether the damper is in the open or closed position. When a fire is desired, the control circuit initiates combustion after receiving the damper signal indicating that the damper is in the open position. In accordance with another aspect, the damper control device may be provided with a mounting ring extending generally perpendicularly from the damper pipe, connecting the damper pipe to the flue. In accordance with another aspect, an adapter can be added to allow passage of air along the flue when an air cooled flue is used.

From the foregoing disclosure and the following more detailed description of various preferred embodiments it will be apparent to those skilled in the art that the present invention provides a significant advance in the technology and art of damper control devices. Particularly significant in this regard is the potential the invention affords for providing a high quality damper control device for fireplaces and other outside applications with increased energy efficiency. Additional features and advantages of various preferred embodiments will be better understood in view of the detailed description provided below.

Figure 1:
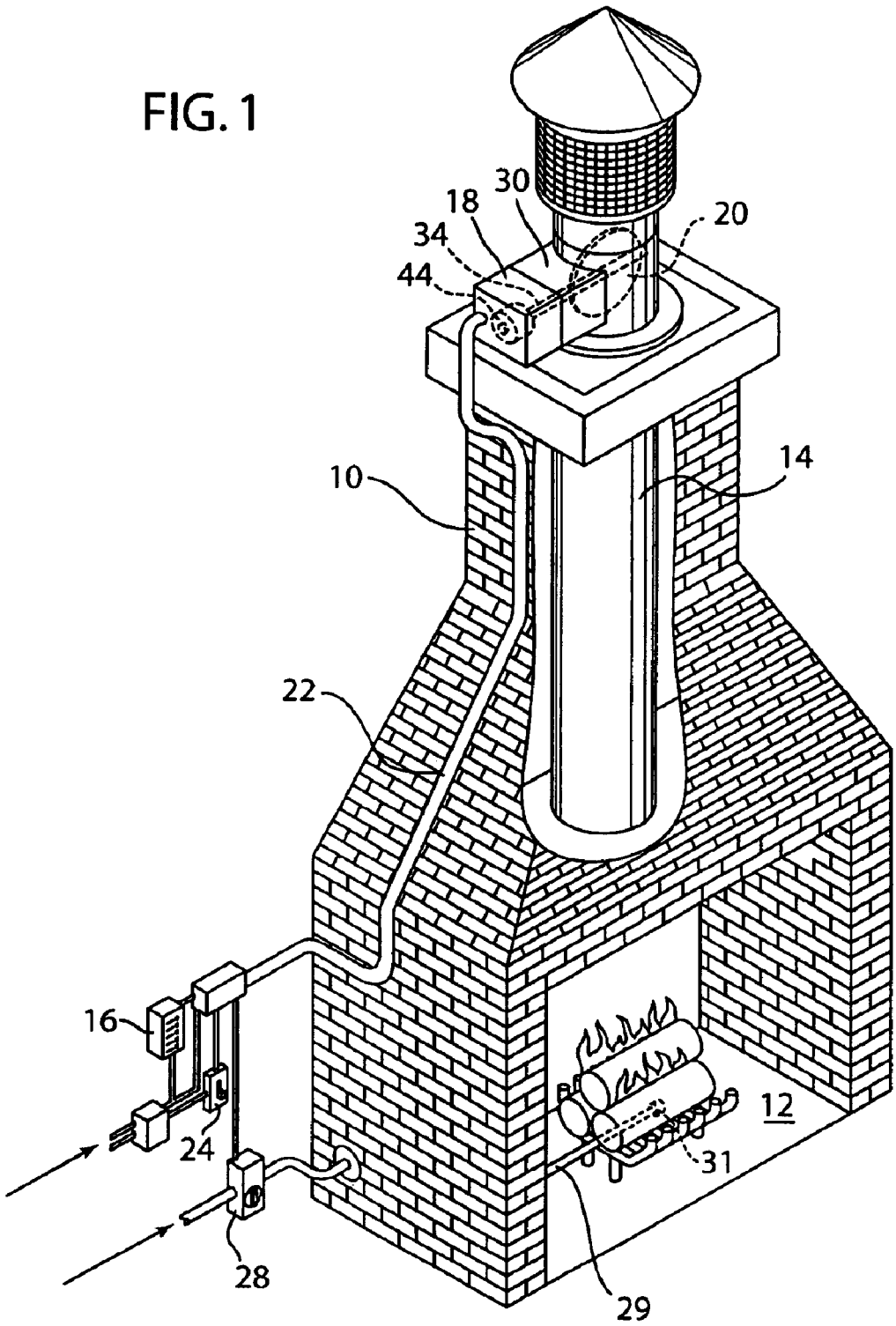
FIG. 1 is a perspective schematic view illustrating a chimney incorporating a damper control device in accordance with a preferred embodiment.

It should be understood that the appended drawings are not necessarily to scale, presenting a somewhat simplified representation of various preferred features illustrative of the basic principles of the invention. The specific design features of the damper control device as disclosed here will be determined in part by the particular intended application and use environment. Certain features of the illustrated embodiments have been enlarged or distorted relative to others to facilitate visualization and clear understanding. In particular, thin features may be thickened, for example, for clarity of illustration. All references to direction and position, unless otherwise indicated, refer to the orientation illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the damper control device disclosed here. The following detailed discussion of various alternative and preferred features and embodiments will illustrate the general principles of the invention with reference to a damper control device for a gas fireplace. Other embodiments suitable for other applications, such as wood burning fireplaces, will be apparent to those skilled in the art given the benefit of this disclosure.

Turning now to the drawings, FIG. 1 shows a chimney 10 having a fireplace 12, a flue 14 which receives products of combustion from the fireplace, and a damper 20. In the preferred embodiment shown here, the fireplace is a gas fireplace, with the gas supplied by a gas line 29. The damper 20 is movable between a closed position where it prevents outside air from flowing down into the flue and from there leaking into a house, to an open position (as shown in FIG. 1) where the products of combustion can escape to the outside. The damper has wiring 22 connecting to a power source and optionally connecting to a status module 16 (which can be remote from the fireplace 12). An on/off switch 24 may be provided to control power to a damper motor 44 (shown in FIG. 1), to control power to send a fireplace signal to open a gas valve 28 in a gas line. It will be readily apparent to those skilled in the art, given the benefit of this disclosure, that the on/off switch could be incorporated into a handheld wireless or remote device and that such a remote device can be used when a fire is desired at the fireplace.

Figure 2:
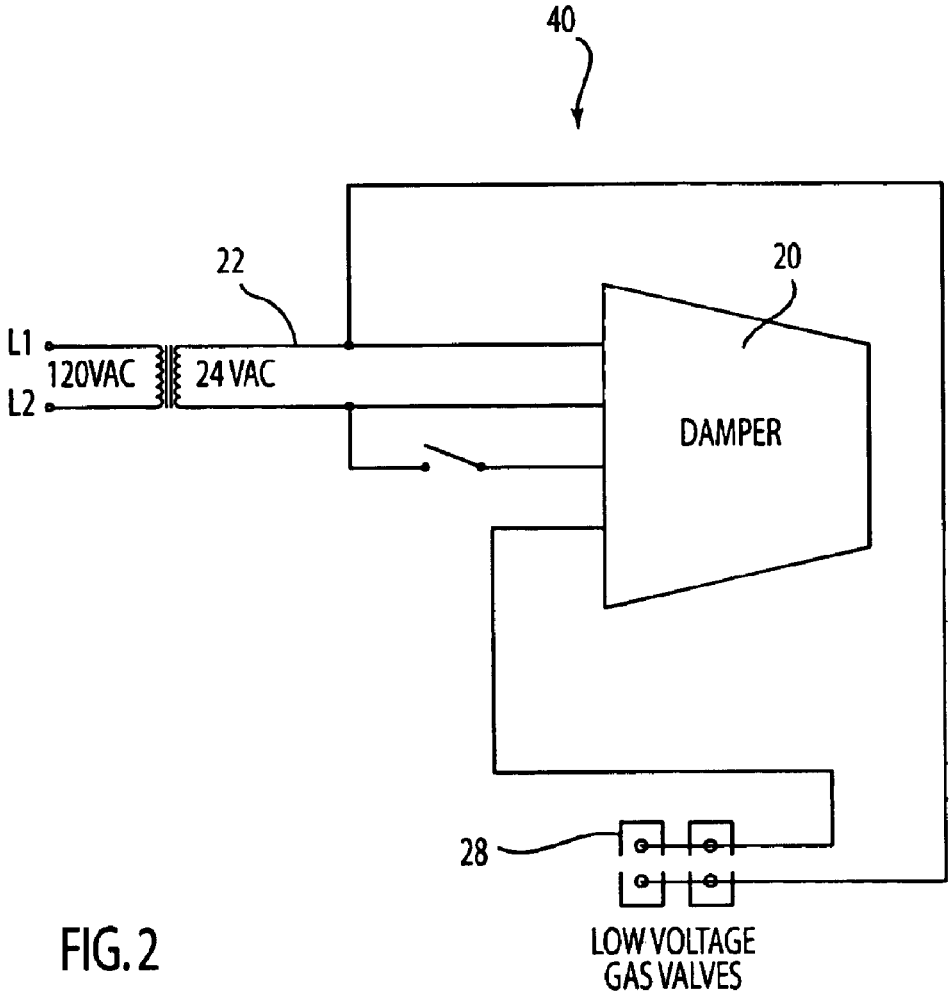
FIG. 2 is a simplified schematic of a control circuit for a damper control device in accordance with a preferred embodiment.

A schematic of a control circuit 40 showing wiring 22 connecting the damper 20 to the gas valves 28 is shown in FIG. 2. The power source shown would be a conventional home power source, 120V AC current. The control circuit can comprise a printed circuit board with limit switches (not shown). The motor 44 rotates the output shaft 34 and damper 20 (shown best in FIG. 4). The limit switches would be connected to a cam (not shown) that is slaved with the damper 20 to engage the switches as the damper moves between the open and closed positions. The status module may optionally be provided with a printed circuit board with built-in time-delay for returning the damper to the closed position at a predetermined time after the fireplace fire is extinguished.

When the fireplace is put in use, an electric signal from a control (e.g., manual switch 24, etc.) generates the fireplace signal to open the gas valve. Prior to this, however, the damper 20 is sent a call to move to the open position. Through the use of the limit switches, the damper sends a damper signal indicating whether the damper is in the open position or closed position. In accordance with a highly advantageous feature, only when the damper has moved to the open position will combustion be initiated.

Figure 3:
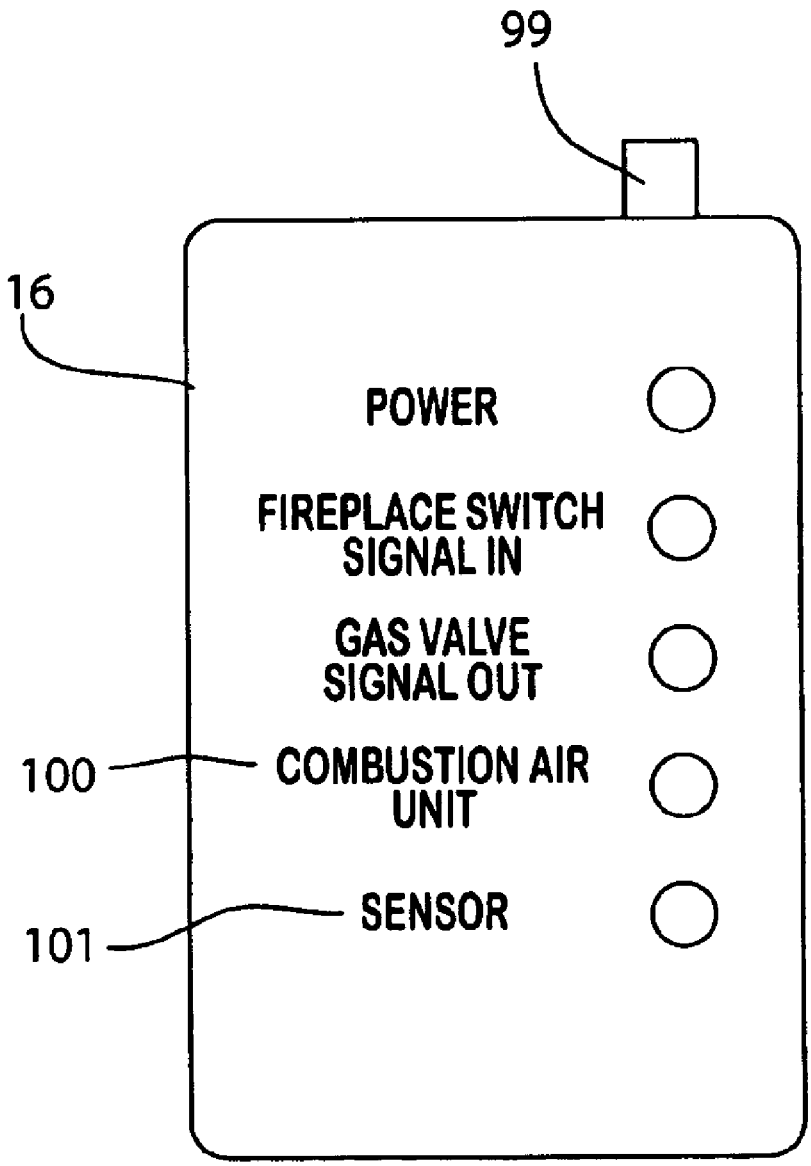
FIG. 3 shows an optional status module indicating the status of various elements of the damper control device.

As shown in FIG. 3, optionally a status module 16 may be provided, electronically connected to the damper 20 and to the fireplace gas valves and igniter 31. This module would consist of lights indicating the status of the damper for either operational or troubleshooting purposes. In the preferred embodiment shown in FIG. 3, indicator lights would respond to a signal indicating several different conditions. These conditions can comprise, for example, whether the overall system has power, whether the damper is open (as indicated by a damper signal), and whether the fireplace signal has been sent, etc. The status module may also optionally be provided with a service switch 99 to hold the damper in the open position in the event of intermittent operation, allowing the fireplace to be used while waiting for service.

Moreover, the status module 16 optionally may indicate at 100 whether a second damper is open, in those preferred embodiments where a second damper is used. Such applications can comprise, for example, designs where air used in combustion of gas is drawn from the outside. As a further option, the status module may also be connected to the control circuit so as to indicate a response from a sensor signal from a sensor which senses a pollutant such as, for example, carbon dioxide or carbon monoxide levels, or heat in the house. A sensor as described here could be particularly useful with wood burning applications. When such pollutant reaches a predetermined criteria the control circuit would send a signal to move the damper 20 to the open position and to indicate this at 101 on the status module. Such an indication or alarm can be a light or an audible sound, for example. In some preferred embodiments neither the combustion air unit 100 or pollutant sensor 101 is used. In such circumstances neither indicator would be necessary on the status module. Other combinations of features will be readily apparent to those skilled in the art given the benefit of this disclosure.

Figure 4:
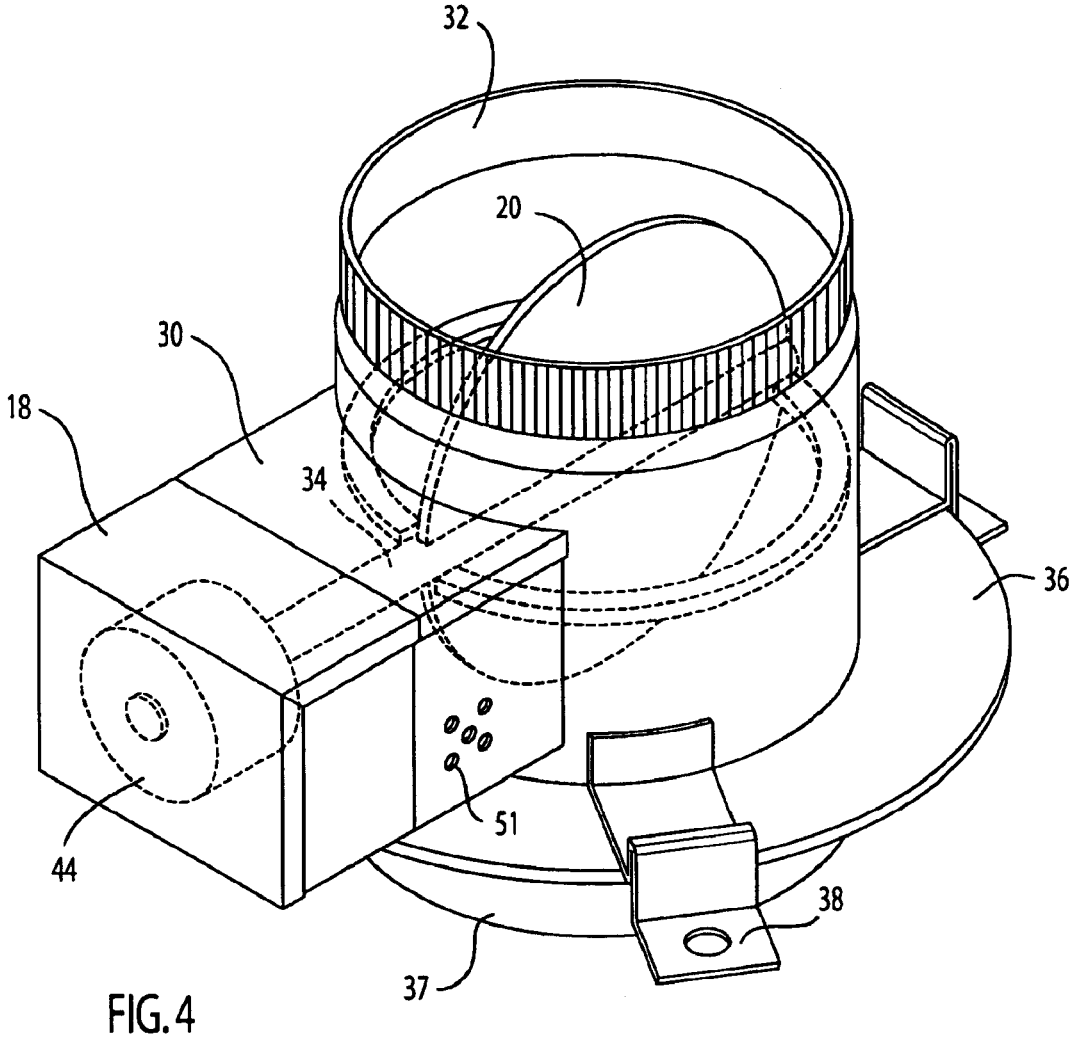
FIG. 4 is a perspective view of a damper, its housing and a damper pipe to connect with a flue.

Turning now to the damper 20 installation in the flue 14, FIG. 4 shows the damper 20 positioned in a damper pipe 32, drive motor and accompanying electronic controls 44 positioned in a preferably weatherproof damper control box 18. Preferably the drive motor and electronic controls are electrically connected to the control circuit via wiring 22 (shown in FIG. 1). To rotate the damper between open and closed positions, a rotatable shaft 34 operatively connects the drive motor and the damper. As the flue can get quite hot during operation of the fireplace, the rotatable shaft serves to space the drive motor and electronic controls away from the flue and damper pipe 32. Also, shaft 34 is preferably at least partially enclosed by shroud 30 to protect the shaft from weathering, dirt, etc. The shroud may optionally be provided with ventilation 51.

In the preferred embodiment shown in FIG. 4, a portion 37 of the damper pipe 32 may extend beyond a mounting member 36, shown here as a ring-like structure. The portion 37 is adapted to fit inside the flue 14, and mounting brackets 38 are adapted to receive bolts that would fit into the chimney, thereby securing the damper 20 and damper pipe 32 to the chimney.

Figure 5:
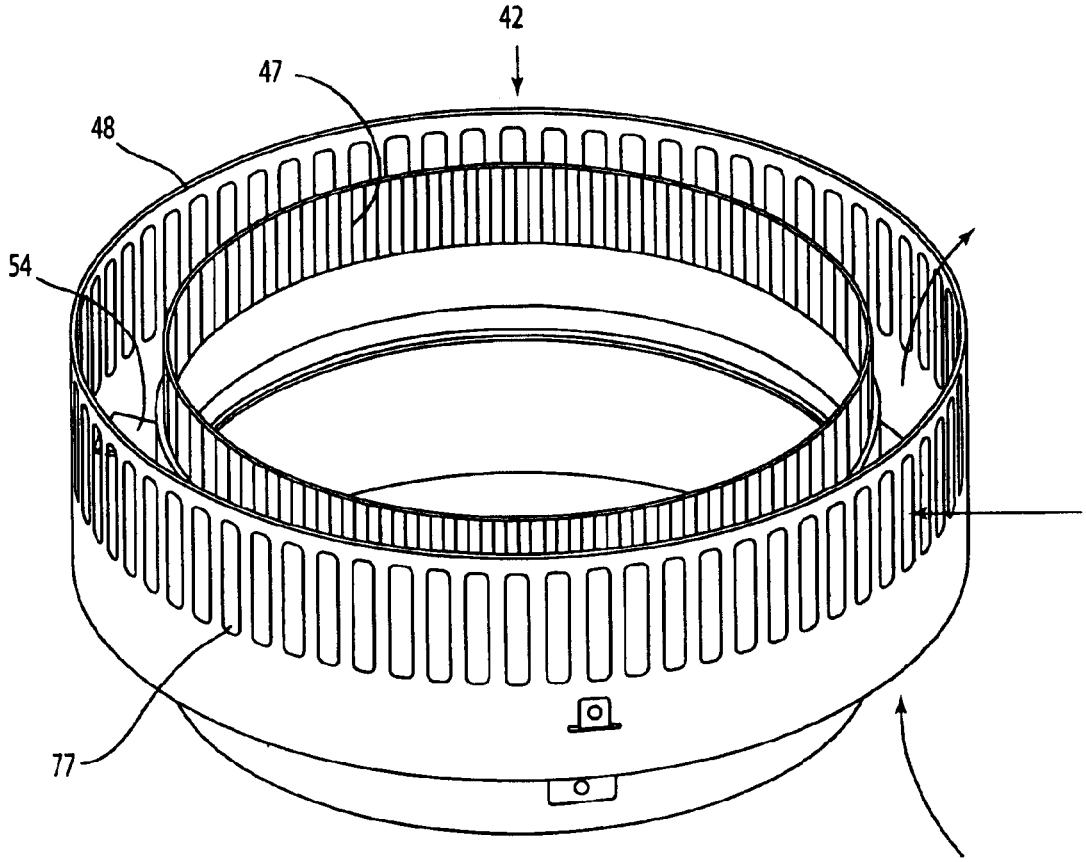
FIG. 5 is a perspective view of an adapter suitable for use with the damper pipe when the damper is to be installed in an air-cooled flue.
Figure 6:
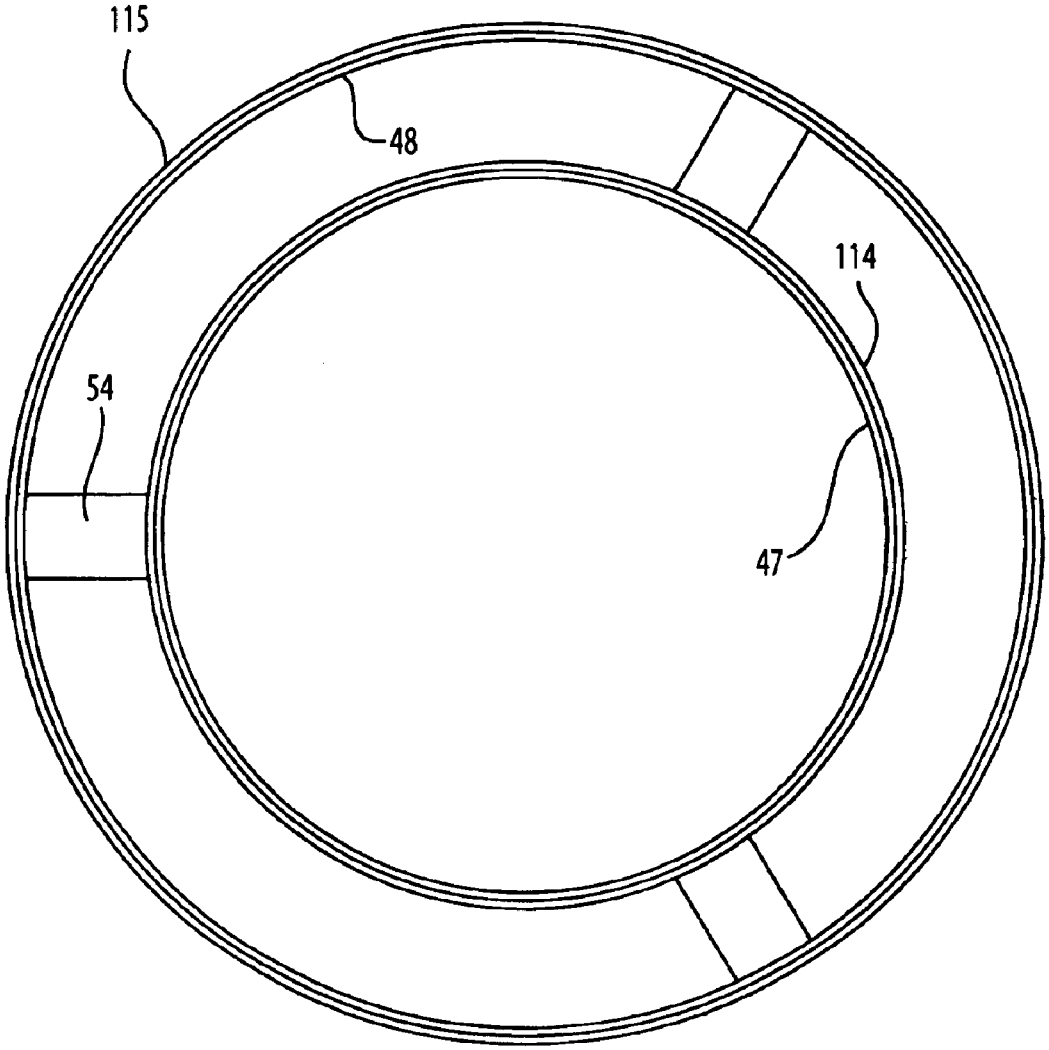
FIG. 6 is a schematic view of the adapter connected to an air cooled flue.

FIGS. 5–6 are associated with another preferred embodiment where an air cooled flue is used. In an air cooled flue, an outer sleeve 115 is spaced apart from the flue 114, permitting air to flow past the flue and transfer heat. So that the damper does not block this flow of air, an adapter 42 is provided. The adapter 42 has an interior pipe 47, an exterior pipe 48, and spacers 54 connecting the interior pipe and exterior pipe so as to permit air to pass through a first air passageway around the adapter and reach the flue. The exterior pipe may be provided with a series of openings 77 forming a second air passageway. As shown in the schematic view of FIG. 6, preferably the inner pipe 47 fits snugly inside the flue 114, and the external pipe 48 fits snugly against the outer sleeve 115. Other connections between the adapter and the flue will be readily apparent to those skilled in the art given the benefit of this disclosure.

The flue 14, damper pipe 32, and adapter pipes 47, 48 as well as the shroud 30 and damper control box 18 may optionally be constructed from sheet metal. The chimney 10 may be made of bricks. In such embodiments, the flue may also be formed as a separate tube or merely as a passageway in the bricks.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A damper control device comprising, in combination:

a fireplace and a flue, wherein products of combustion from the fireplace enter the flue;

a damper positioned in a damper pipe operatively connected to the flue, wherein the damper is movable between a closed position where the damper pipe is blocked and an open position;

a motor having a rotatable shaft extending therefrom operatively connected to the damper; and a control circuit which transmits a fireplace signal to open a gas valve to initiate combustion and to close a gas valve terminate combustion at the fireplace, and which receives a damper signal indicating whether the damper is in the closed position or the open position;

wherein when a fire is desired at the fireplace, the control circuit sends the fireplace signal to open the gas valve after receiving the damper signal indicating that the damper is in the open position; and a status module comprising at least one indicator which indicates the status of whether the fireplace signal has been sent.

2. The damper control device of claim 1 wherein the fireplace is a gas fireplace and after the damper is in the open position the control circuit sends the fireplace signal to the fireplace to ignite gas at the gas fireplace.

3. The damper control device of claim 2 wherein the damper moves to the closed position at a predetermined time after the gas fireplace circuit has sent the fireplace signal to terminate combustion by shutting off the gas at the gas fireplace.

4. The damper control device of claim 1 wherein the damper is positioned near a top of the flue.

5. A damper control device comprising, in combination:

a fireplace and a flue, wherein products of combustion from the fireplace enter the flue;

a damper positioned in a damper pipe operatively connected to the flue, wherein the damper is movable between a closed position where the damper pipe is blocked and an open position;

a motor having a rotatable shaft extending therefrom operatively connected to the damper; and a control circuit which transmits a fireplace signal to open a gas valve to initiate combustion and to close a gas valve terminate combustion at the fireplace, and which receives a damper signal indicating whether the damper is in the closed position or the open position;

wherein when a fire is desired at the fireplace, the control circuit sends the fireplace signal to open the gas valve after receiving the damper signal indicating that the damper is in the open position; and a status module comprising a manually operated service switch to send a signal to hold the damper in the open position.

6. The damper control device of claim 5 wherein the status module has an indicator which indicates the status of one of: whether the damper signal indicates the damper is in the open position or the closed position; whether the fireplace signal has been sent; and whether the damper control device has power.

7. The damper control device of claim 1 wherein the control circuit sends a signal to hold the damper in the open position in response to predetermined criteria comprising at least one of heat, carbon dioxide concentration, and carbon monoxide concentration.

8. A damper control device comprising, in combination:

a damper pipe adapted to be connected to a flue and receive products of combustion;

a damper positioned in the damper pipe and movable between a closed position and an open position;

a motor having a rotatable shaft extending therefrom operatively connected to the damper, wherein the motor is housed in a damper control box remote from the products of combustion;

a control circuit which controls the motor to rotate the shaft and in turn rotate the damper to the closed position and to the open position; and a mounting member, wherein the mounting member is a plate extending generally perpendicularly from the damper pipe and is adapted to connect to a chimney.

9. The damper control device of claim 8 further comprising mounting brackets affixed to the mounting member and adapted to connect to the chimney.

10. The damper control device of claim 8 wherein a projection of the damper pipe extends past the mounting member and is adapted to enter the flue.

11. The damper control device of claim 8 wherein the shaft extends from the damper control box to the damper pipe and is at least partially enclosed by a shroud.

12. The damper control device of claim 11 wherein the shroud is provided with ventilating holes.

13. A damper control device comprising, in combination:

a damper pipe;

a damper positioned in the damper pipe and movable between a closed position and an open position;

a motor having a rotatable shaft extending therefrom operatively connected to the damper;

a control circuit which controls the motor to rotate the shaft and in turn rotate the damper to the closed position and to the open position; and an adapter comprising an interior pipe and an exterior pipe connected to the interior pipe, with a first air passageway formed between the interior pipe and the exterior pipe and a second air passageway formed in the exterior pipe so that air can pass through the first and second air passageways and past the adapter;

wherein the interior pipe is connected to the damper pipe and adapted to be connected to an air-cooled flue.

14. The damper control device of claim 13 wherein the interior pipe is adapted to fit snugly inside the air-cooled flue.

* * * * *